US007096599B2

(12) United States Patent
Kural et al.

(10) Patent No.: US 7,096,599 B2
(45) Date of Patent: Aug. 29, 2006

(54) HOUSEHOLD APPLIANCE

(76) Inventors: Cem Kural, Arcelik A. S., E5 Ankara Asfalti Uzeri, Tuzla, Istanbul (TR) 81719; Serdal Elmas, Arcelik A. S., E5 Ankara Asfalti Uzeri, Tuzla, Istanbul (TR) 81719

( * ) Notice: Subject to any disclaimer, the term of this patent is extended or adjusted under 35 U.S.C. 154(b) by 0 days.

(21) Appl. No.: 10/497,868

(22) PCT Filed: Dec. 6, 2001

(86) PCT No.: PCT/TR01/00063

§ 371 (c)(1),
(2), (4) Date: Jan. 18, 2005

(87) PCT Pub. No.: WO03/048443

PCT Pub. Date: Jun. 12, 2003

(65) Prior Publication Data

US 2005/0120580 A1 Jun. 9, 2005

(51) Int. Cl.
*F26B 3/347* (2006.01)
*H05B 6/50* (2006.01)
*H05B 6/76* (2006.01)

(52) U.S. Cl. ..... 34/259; 34/260; 219/709; 219/737

(58) Field of Classification Search ..... 34/259, 34/260, 261; 219/702, 709, 736, 737
See application file for complete search history.

(56) References Cited

U.S. PATENT DOCUMENTS

| | | | | |
|---|---|---|---|---|
| 3,295,022 | A * | 12/1966 | Schelisch | 361/113 |
| 3,550,008 | A * | 12/1970 | James | 375/339 |
| 4,431,965 | A | 2/1984 | Aslan | |
| 5,325,600 | A | 7/1994 | Gentile | |
| 5,606,804 | A | 3/1997 | Smith et al. | |

FOREIGN PATENT DOCUMENTS

| | | | |
|---|---|---|---|
| JP | 03250578 A | * | 11/1991 |
| JP | 04010384 A | * | 1/1992 |
| WO | WO 93/13635 | | 7/1993 |
| WO | WO 01/57457 | | 8/2001 |

* cited by examiner

*Primary Examiner*—Jiping Lu
(74) *Attorney, Agent, or Firm*—Ellis & Venable PC

(57) ABSTRACT

A household appliance (1) e.g a washer-dryer, comprises an enclosure (2) into which objects to be heated are placed, a magnetron (4) for generating microwaves, a waveguide (3) for feeding the generated microwave into the enclosure, an arc detector (5) coupled to the waveguide (3) for detecting the arcing within the enclosure (2) and a control unit (6).

4 Claims, 1 Drawing Sheet

HOUSEHOLD APPLIANCE

The present invention relates to a household appliance especially a washer/dryer which utilizes microwave heating safely.

Household appliances wherein microwave energy is used for heating objects, for example heating fabrics in dryers, is well known in prior art. The major drawback of heating by using microwave energy is the occurrance of arcs which is an electrical breakdown phenomena caused between two conductors such as metal zippers, buttons, small metal objects that clothing may have. Arcs may cause the objects to melt or burn. Studies have been made to prevent arcing around the metallic structures inside the enclosure where microwave fields are applied.

U.S. Pat. No. 5,325,600 features a UV tube detector placed in proximity to the clothing for sensing a resonant arcing condition; but it is not an easy way for sensing and mounting in a turning drum and leads to a lot of constructional problems.

U.S. Pat. No. 5,321,897 provides a means for eliminating the risk of arcing by sensing the temperature of the exhaust air; but it is a risky way of eliminating arcing since arcing may occur although temperature sensed in the exhaust duct is low in the microwave permeable drum.

WO 93/13635 provides an arc detector mounted in a wall of the dryer chamber to detect arcing in a microwave permeable drum and a method for monitoring electric field strength within the chamber and providing an output signal in the event of a sudden decrease in the field strength due to arcing.

EP 0088175 provides an output for the microwave power means which is arranged to protect such power means from abnormally reflected power but it does not provide any means for arc detection.

WO 01/57457 discloses an arc detector that is placed onto the waveguide for measuring the reflected power. Since reflected power is measured, an isolator is placed for isolating the arc detector from the forward power which is a very expensive solution.

The object of the invention is to provide a household appliance, especially a washer/dryer, utilising microwave heating, comprising an arc detector for detecting arcing during microwave heating of objects namely clothing.

Figure 1:
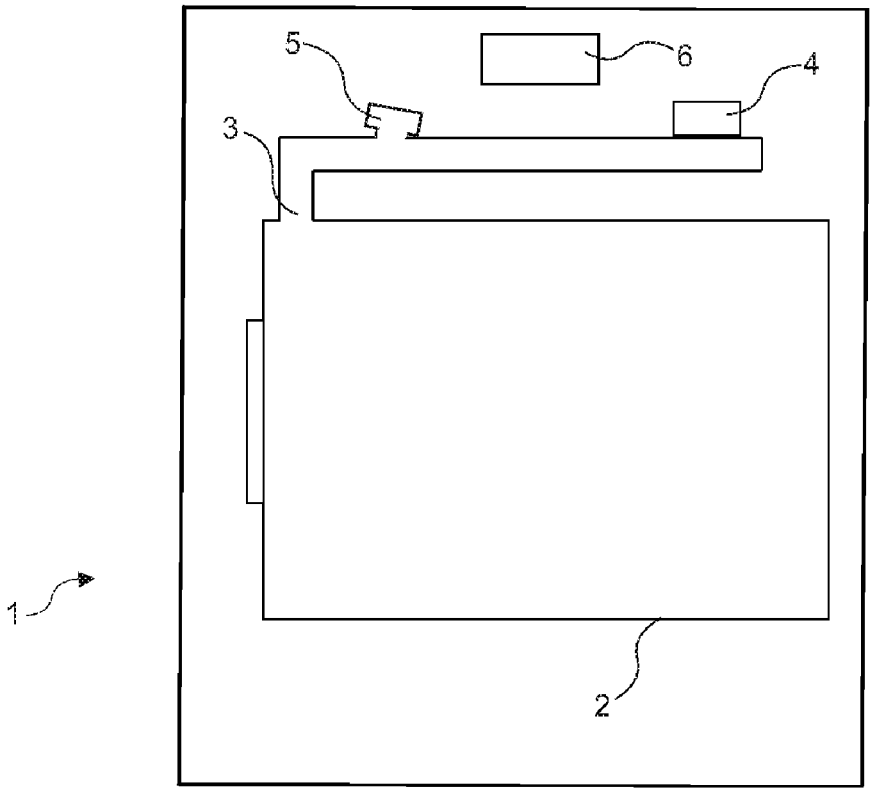

An embodiment of the household appliance realized in order to attain the object of the present invention is illustrated in the attached drawings, wherein:

FIG. 1—is a schematic view of the household appliance.

Figure 2:
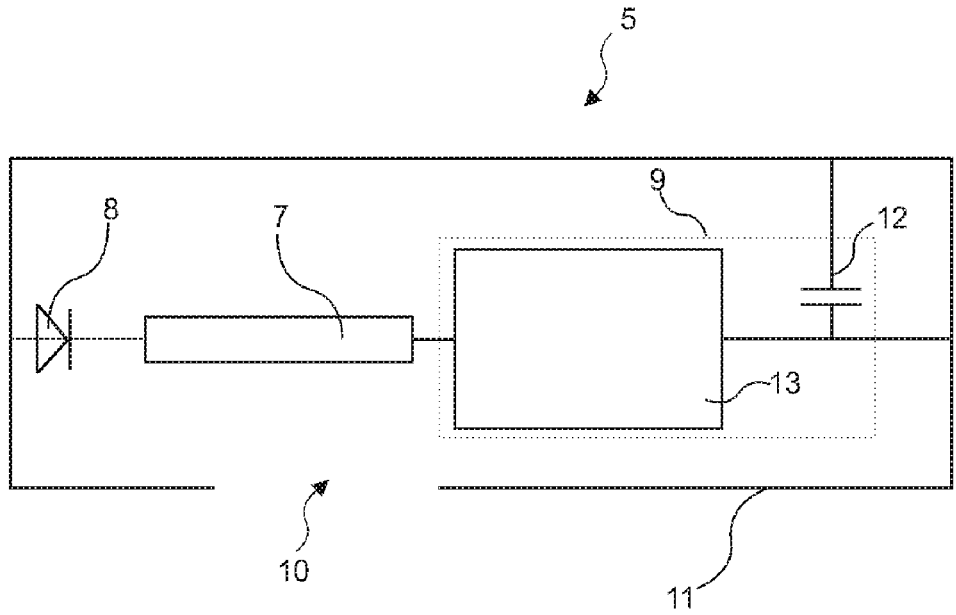

FIG. 2—is a schematic view of the arc detector.

The components shown in the drawings have been numerated as follows:

1. Household appliance
2. Enclosure
3. Waveguide
4. Magnetron
5. Arc detector
6. Control unit
7. Antenna
8. Microwave diode
9. Filtering means
10. Slot
11. Casing
12. Capacitor
13. Ferrite component A household appliance (1), especially a washer-dryer, comprises an enclosure (2) into which objects to be heated, such as clothing, are placed, a magnetron (4) for generating microwaves, a waveguide (3) for feeding the generated microwave into the enclosure (2), an arc detector (5) coupled to the waveguide (3) for detecting the arcing within the enclosure (2) and a control unit (6).

The waveguide (3) and the arc detector (5) comprise slots (10). The arc detector (5) is coupled to the waveguide (3) in such a way that slots (10) coincide and get the signal representing the field inside the waveguide (3) into the arc detector (5) from the waveguide.

The arc detector (5) also comprises an antenna (7) to capture the signal, a filtering means (9), preferably comprising a capacitor (12) and/or a ferrite element component (13), to filtre the noise on the antenna (7), a microwave diode (8) to rectify the signal and a casing (11) for protecting all the components of the arc detector (5) from the noise and to avoid any microwave leakage.

The arc detector (5) is preferably mounted with an inclination onto the waveguide (3) to get the desired signal efficiently. The arc detector (5) is mounted on the waveguide (3) in a position depending on the guided wavelength of the waveguide (3) and the total empedance of the household appliance (1).

During the operation of the household apliance (1), the objects that are placed within the enclosure (2) are heated by using microwave energy. During the microwave heating of objects, the electric field within the waveguide (3) and the enclosure (2) changes gradually if arcs do not occur. However, electric field changes abruptly if any arc occurs inside the enclosure (2). The arc detector (5) measures electric field values and sends a signal representing the electric field values to the control unit (6). The control unit (6) has any means of signal comparison which compares the input signal coming from the detector (5) on the waveguide (3) with the predetermined reference signal that simulates the no-arcing condition. If control unit (6) has an input signal which differs from the predetermined amount, microwave power is decreased and the arc detector (5) continues to monitor electric field. If arcing continues at this second stage in which power is reduced, microwave power is interrupted.

The invention claimed is:

1. A household appliance (1) including an enclosure (2) into which objects to be heated are placed, a magnetron (4) for generating microwaves, a waveguide (3) for feeding the generated microwave into the enclosure (2), an arc detector (5) for detecting the arcing within the enclosure (2) and a control unit (6), wherein the arc detector (5) comprises an antenna (7) to capture the signal representing the field inside the wavegnide (3), a filtering means (9) to filter the noise on the antenna (7), a microwave diode (8) to rectify the signal and a casing (11), for protecting all the components of the arc detector (5) from the noise and to avoid any microwave leakage and wherein the wavegnide (3) and the arc detector (5) comprise slots (10) and the arc detector (5) is coupled to the wavegnide (3) in such a way that slots (10) coincide and get the signal into the arc detector (5) from the waveguide.

2. A household appliance (1) as claimed in claim 1, wherein the detector (5) is mounted with an inclination onto the waveguide (3) to get the desired signal efficiently.

3. A household appliance (1) as claimed in claim 1 wherein the filtering means (9) comprises a capacitor (12) and/or a ferrite component (13).

4. A household appliance (1) according to any one of the claims 1, 2, or 3 which is a washer-dryer.

* * * * *